US006206809B1

(12) United States Patent
Habing et al.

(10) Patent No.: US 6,206,809 B1
(45) Date of Patent: Mar. 27, 2001

(54) EXERCISE APPARATUS

(75) Inventors: Theodore G. Habing, Santa Ana, CA (US); Kenneth W. Stearns, Houston, TX (US)

(73) Assignee: Dream Visions, L.L.C., Santa Ana, CA (US)

( * ) Notice: Subject to any disclaimer, the term of this patent is extended or adjusted under 35 U.S.C. 154(b) by 0 days.

(21) Appl. No.: 09/072,681

(22) Filed: May 5, 1998

(51) Int. Cl.[7] ..... A63B 21/068

(52) U.S. Cl. ..... 482/96; 482/95; 482/142; 482/140

(58) Field of Search ..... 482/93, 94, 95, 482/96, 142, 148, 130, 140

(56) References Cited

U.S. PATENT DOCUMENTS 4,489,936 * 12/1984 Dal Monte ..... 482/96
5,147,267 * 9/1992 Kunewalder ..... 482/96
5,346,447 * 9/1994 Stearns ..... 482/96
5,545,114 * 8/1996 Gvoich ..... 482/140
5,665,041 * 9/1997 Hsieh ..... 482/140
5,702,334 * 12/1997 Lee ..... 482/95 X
5,746,688 * 5/1998 Pragen ..... 482/140 X
5,769,766 * 6/1998 Huang ..... 482/95 X
5,792,035 * 8/1998 Ward ..... 482/140
5,833,590 * 11/1998 Chiu ..... 482/140 X

* cited by examiner

*Primary Examiner*—Danton D. DeMille
*Assistant Examiner*—William LaMarca
(74) *Attorney, Agent, or Firm*—Nick A. Nichols, Jr.

(57) ABSTRACT

In an exercise apparatus a rigid frame includes upper and lower back supports pivotally connected in axial alignment. Upper and lower back support pads are mounted on the rigid frame for supporting a user in a reclined position with the weight of the user providing resistance to the exercises. Leverage arms are mounted at the head end of the upper back support. The leverage arms extend above the rigid frame such that the free ends thereof may be grasped by the user while performing abdominal exercises. The lower back support includes handles extending outwardly from the foot end thereof for grasping by the user while performing glute exercises. A thigh pad is mounted on the upper end of a lever arm pivotally attached to the foot end of the lower back support. Upon pushing the thigh pad by the user, the foot end of the rigid frame is raised along with the body of the user. Abdominal curls or crunching exercises are performed by grasping the leverage arms and pulling up the upper back support. An adjustable resistance wheel is provided for varying resistance to the exercises.

12 Claims, 6 Drawing Sheets

FIG. 10
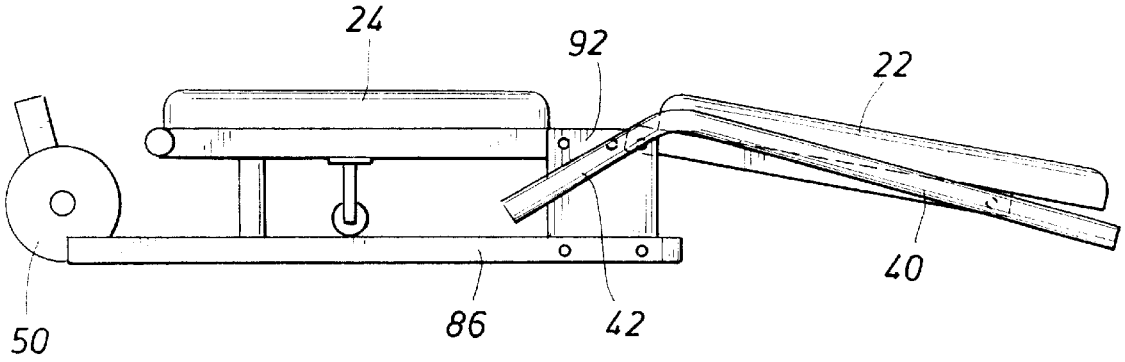
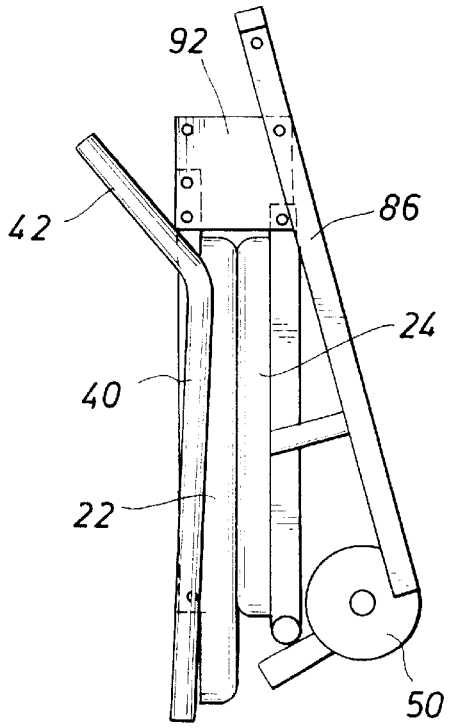
FIG. 11

EXERCISE APPARATUS

BACKGROUND OF THE INVENTION

This invention relates to an exercise device, particularly a variable resistance exercise device for strengthening the abdominal and gluteus muscles. The present invention includes a platform or bench to support a user in a reclining position with resistance to the exercise provided by the weight of the user.

The fitness industry has heretofore provided various exercise devices, particularly for home use, for exercising a user's lower torso. U.S. Pat. No. 4,489,936 issued on Dec. 25, 1984, provides a platform or board to support a user in a reclining position with the weight of the user providing resistance to the exercises. A movable frame having a single nonadjustable pivot axis is actuated by the user and may be positioned at selected fulcrum points along the platform to provide the desired resistance. Such an exercise machine is relatively inexpensive and can be utilized for exercising various body muscles.

In U.S. Pat. No. 5,346,447 issued on Sep. 13, 1994, an exercise machine is provided having a platform on which a user is supported in a reclining position. The weight of the user is utilized as the resistance for various exercises performed on the exercise machine. A lever pivotally connected to the platform may be actuated by the user for raising or lowering one end of the platform with respect to a pivot point. U.S. Pat. No. 5,545,114 issued on Aug. 13, 1996 provides an exercise device for exercising the upper and lower abdomen and the back. The device includes rigid upper and lower back supports which are pivotally joined. Resistance means attach to the pivotal portions of the device to allow adjustable resistance to exercise motions. Each of the above described devices however are directed to one mode of exercise for strengthening specific muscles.

It is therefore an object of the present invention to provide an exercise device which is light weight and portable utilizing the user's body weight to provide resistance to the exercises.

It is another object of the present invention to provide an exercise device in which the glute and abdominal muscles are exercised while the user is in a prone or supine position.

It is another object of the present invention to provide an exercise device in which the exercise resistance is adjustable providing a means of progressive resistance exercise.

Other objects, features and advantages of the present invention will become apparent after referring to the following specification and drawings.

SUMMARY OF THE INVENTION

The exercise apparatus of the present invention includes a rigid frame having upper and lower back supports pivotally connected in axial alignment. Upper and lower back pads are mounted on the upper and lower back supports for supporting a user in a reclined position with the weight of the user providing resistance to the exercises. Leverage arms are mounted at the head end of the upper back support. The leverage arms extend above the rigid frame such that the free ends thereof may be grasped by the user while performing abdominal exercises. The lower back support includes handles extending outwardly from the foot end thereof for grasping by the user while performing glute exercises. A thigh pad is mounted on the upper end of a lever arm pivotally attached to the lower back support. Upon the application of lifting force against the thigh pad by the user, the lower back support of the rigid frame is raised along with the body of the user. Abdominal curls or crunching exercises are performed by grasping the leverage arms and pulling up the upper back support. The apparatus of the invention including means for collapsing the upper and lower back support members for forming a reduced storage profile.

BRIEF DESCRIPTION OF THE DRAWINGS

So that the manner in which the above recited features, advantages and objects of the present invention are attained can be understood in detail, a more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 10 is a perspective view of the exercise apparatus of the invention shown in FIG. 9 partially folded for under bed storage; and FIG. 11 is a perspective of the exercise apparatus of the invention shown in FIG. 9 fully folded for storage.

DETAILED DESCRIPTION OF A PREFERRED EMBODIMENT

Figure 1:
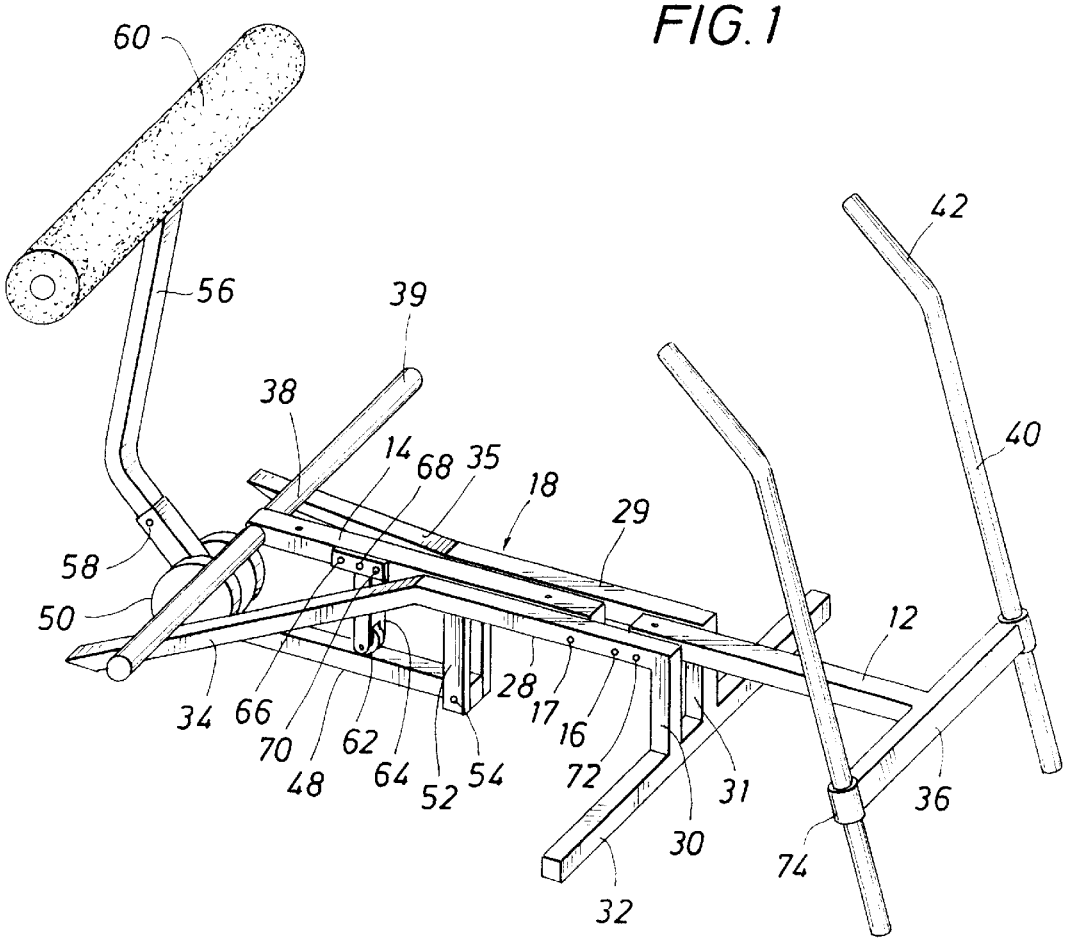
FIG. 1 is a perspective view of the frame of the exercise apparatus of the invention.
Figure 2:
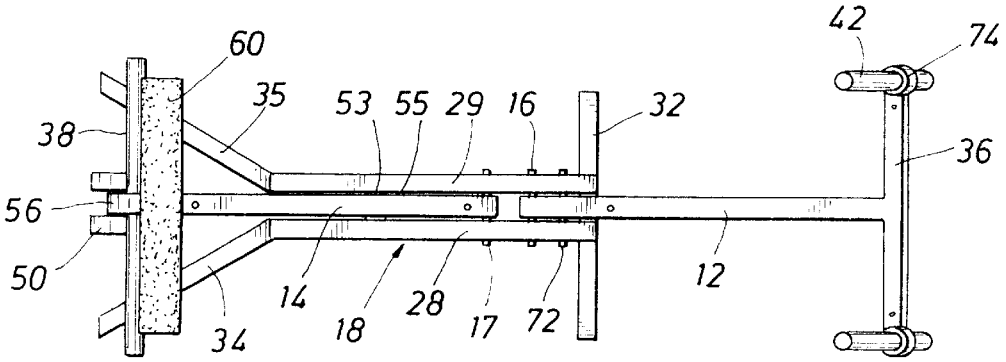
FIG. 2 is a top plan view of the frame of the exercise apparatus of the invention.
Figure 3:
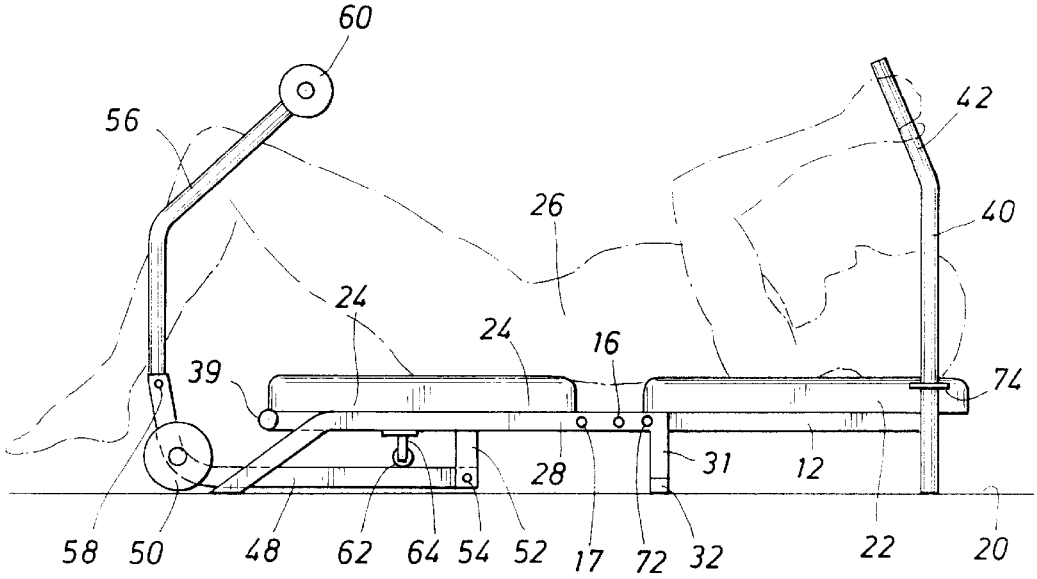
FIG. 3 is a side elevation view of the exercise apparatus of the invention depicting a user in a reclining position on the exercise apparatus in the start position for the upper abdominal exercise.

Referring first to FIGS. 1 and 2, the exercise apparatus of the invention, generally identified by the reference numeral 10, is shown. The exercise apparatus 10 includes an upper back support frame member 12 and a lower back support frame member 14. The frame members 12 and 14 are pivotally joined by pivot pins 16 and 17, respectively, or other conventional pivot connector to a rigid frame 18 which supports the frame members 12 and 14 above a surface, such as a floor 20, as shown in FIG. 3. Back support pads 22 and 24 are mounted on frame members 12 and 14, respectively. A user 26 is in a reclining position on the apparatus 10 with the weight of the user 26 being applied downwardly against the support pads 22 and 24. The back support pads 22 and 24 may be covered with cushioning material for the comfort of the user while lying thereon to perform various exercises on the apparatus 10.

Referring again to FIGS. 1 and 2, the frame members of the apparatus 10 are shown without the back support pads 22 and 24 mounted thereon. The rigid frame 18 includes longitudinally extending support members 28 and 29. The support members 28 and 29 are spaced from each other defining a gap therebetween. The support members 28 and 29 include posts 30 and 31 extending downwardly from one end of the support members 28 and 29. The lower end of the posts 30 and 31 are mounted to a transverse base 32. The opposite ends of the support members 28 and 29 include angularly extending portions 34 and 35 which extend downwardly and outwardly toward the floor 20. The support members 28 and 29 include a horizontally extending portion between the opposite end thereof.

Referring still to FIGS. 1 and 2, the frame members 12 and 14 include transverse members 36 and 38 attached at opposite ends thereof. The frame members 12 and 14, the horizontal portion of support members 28 and 29 and transverse members 36 and 38 lie in a common horizontal plane for supporting the back support pads 22 and 24. The support pads 22 and 24 (not shown in FIGS. 1 and 2) are bolted or otherwise secured to the frame members 12 and 14 and transverse members 36 and 38.

Leverage arms 40 are attached at the head end of the apparatus 10 at each end of the frame member 36. The arms 40 extend vertically upward above the frame member 36 terminating at angularly extending handles 42 and extend downwardly from the frame member 36 to the support surface 20, as shown in FIG. 3. The arms 40 and rigid frame 18 support frame members 12 and 36 above the surface 20.

A thigh pad assembly is pivotally connected below the frame member 14. The thigh pad assembly comprises a lever arm 48 having rollers 50 mounted at the distal end of the lever arm 48. The lever arm 48 is pivotally connected to a bracket connector 52 depending downwardly from the frame members 28 and 29. The base 53 of the bracket 52 spans the gap 55 between the frame member 28 and 29 and is welded or otherwise secured to the bottom surface of the frame members 28 and 29. A pair of legs depend downwardly from the base 53 to form the U-shaped bracket 52. The bracket arms are spaced from each other and connected to the lever arm 48 at the lower ends thereof. A pivot pin 54 attaches the lever arm 48 to the distal ends of the bracket arms for pivotal movement about the pivot pin 54.

Angular actuator arm 56 is attached at the upwardly, angularly extending end of the lever arm 48 by a lock pin 58. The actuator arm 56 includes a lower portion which extends upwardly from the lever arm 48 away from the support pad 24 and an upper portion angled back toward the support pad 24 and extending above the support pad 24. Thigh pads 60 are mounted on the upper end of the actuator arm 56. The thigh pads 60 are adapted for contact by the upper legs or thighs of the user 26. The rigid frame 18 and bracket 52 support the lower back support frame 14 above the surface 20.

The lower back support frame 14 includes a lower resistance wheel 62 carried on the bottom side of the frame member 14. The resistance wheel 62 is mounted on a post 64 depending downwardly from a channel bracket 66 secured to the frame member 14 by a lock pin 68. A plurality of spaced openings 70 are spaced along the length of the bracket 66 for receiving the lock pin 68 within a selected opening 70 and aligned openings formed in the frame member 14 for selectively locating the resistance wheel 62 relative to the frame member 14.

The position of the resistance wheel 62 relative to the pivot 17 may be adjusted by the user by removing the pin 68 and aligning an opening 70 with an openings formed in the frame member 14 and reinserting the pin 68 to lock the resistance wheel 62 to the frame member 14. Adjusting the location of the resistance wheel 62 toward or away from the pivot pin 17 alters the resistance to the crunching exercises performed by the user 26 by varying the height or distance the lower back support frame 14 is raised as the thigh pad 60 is lifted by the user 26.

Figure 4:
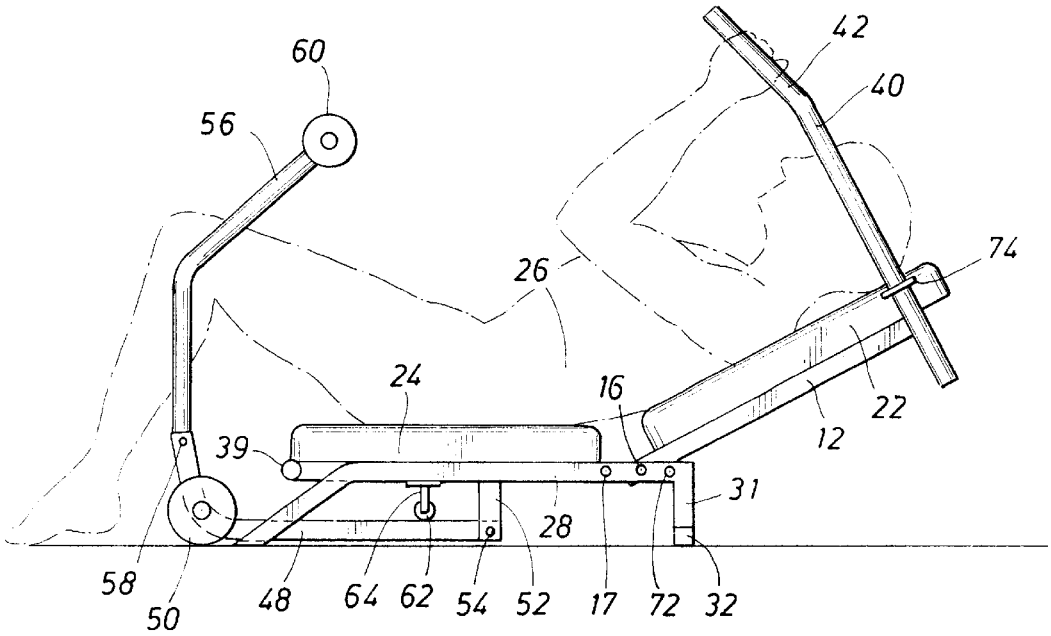
FIG. 4 is a side elevation view of the exercise apparatus of the invention depicting a user on the exercise apparatus in the end position of the upper abdominal exercise.

In operation, user 26 grips the handles 42 of the arms 40 as shown in FIG. 3. A pulling force applied by the user 26 while performing crunching exercises pivots the upper back frame support upward to the position shown in FIG. 4 thereby lifting the head end of the apparatus 10 off the surface 20 as the frame member 12 pivots about the pivot pin 16. Resistance to such movement for exercising the upper abdominal muscles is provided by the body weight of the user 26.

Figure 5:
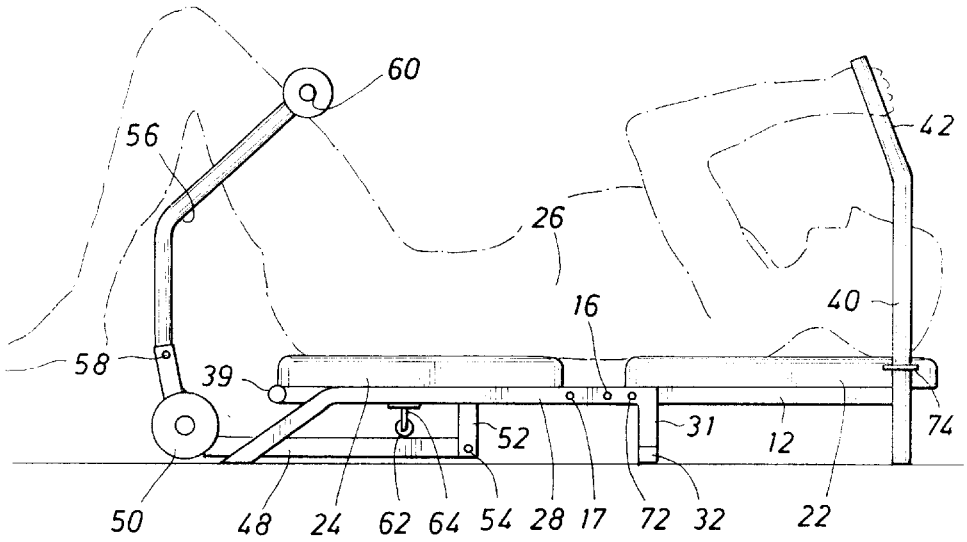
FIG. 5 is a side elevation view of the exercise apparatus of the invention depicting a user in a reclining position on the exercise apparatus in the start position for the lower abdominal exercise.
Figure 6:
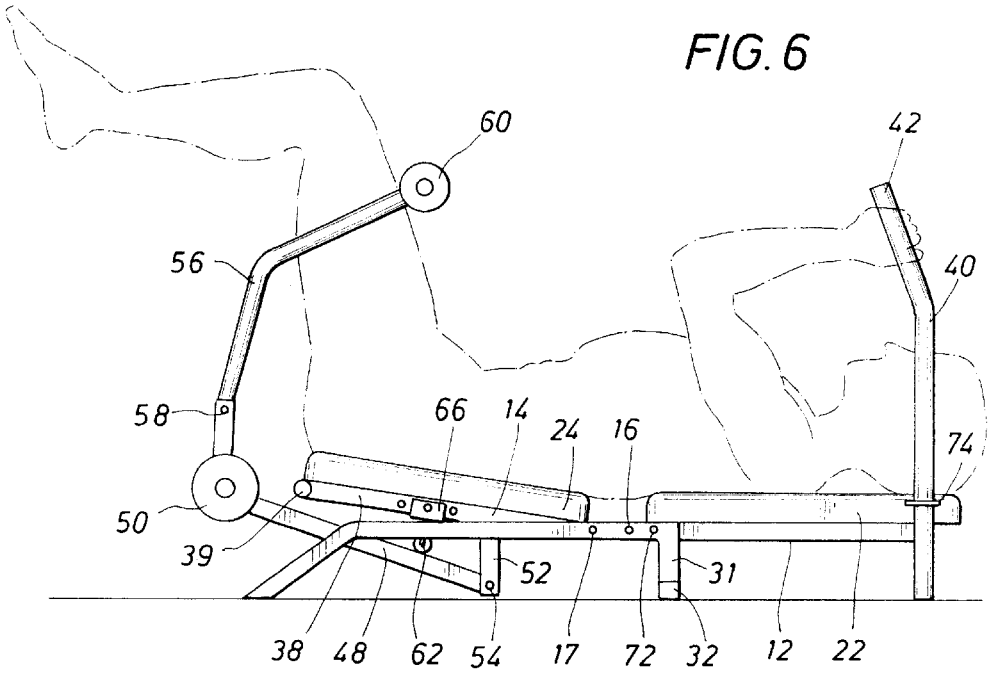
FIG. 6 is a side elevation view of the exercise apparatus of the invention depicting a user on the exercise apparatus in the end position for the lower abdominal exercise.

An alternate exercise for exercising the lower abdominal muscles is shown in FIGS. 5 and 6. The user 26 grips the handles 42 of the arms 40 as shown in FIG. 5 and engages the thigh pads 60 with his upper legs or thighs. A lifting force applied by the user 26 against the thigh pads 60 pivots lever arm 48 to the position shown in FIG. 6. As the lever arm 48 rotates upwardly, the resistance wheel 62 rolls on the surface of the lever arm 48 thereby forcing the lower back support upward as the lower back support frame member 14 pivots about the pivot 17. Resistance to such movement for exercising the lower abdominal muscles is provided by the body weight of the user 26 on the support pad 24 and the resistance of the wheel 62 on the surface of the lever arm 48. These exercises may be performed individually or simultaneously.

Figure 7:
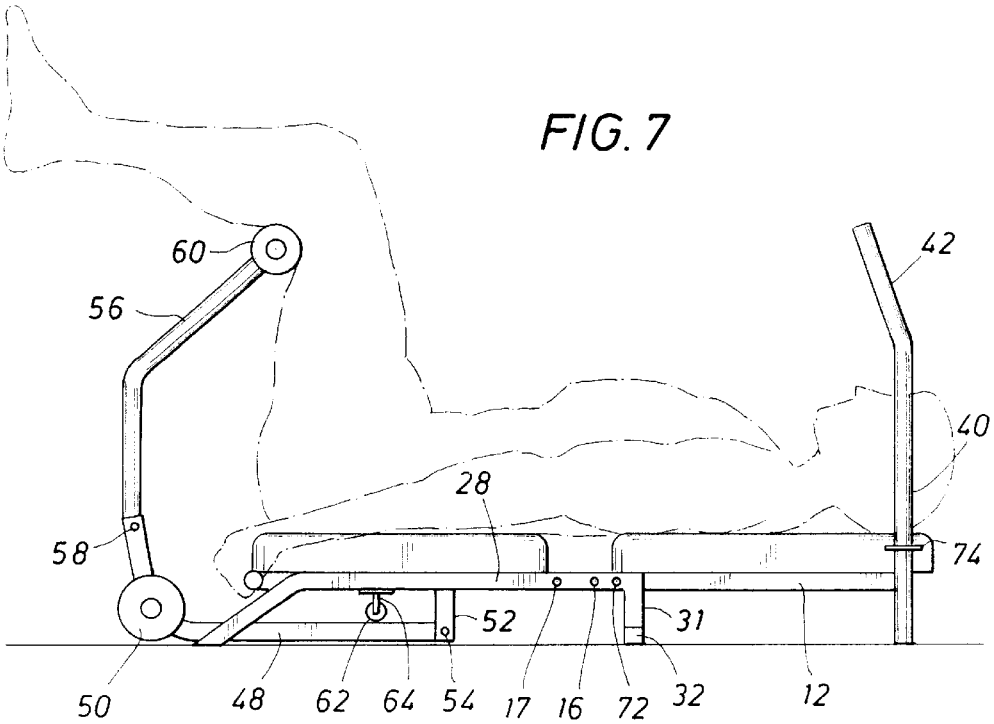
FIG. 7 is a side elevation view of the exercise apparatus of the invention depicting a user in a reclining position on the exercise apparatus in the start position for the glute extension exercise.
Figure 8:
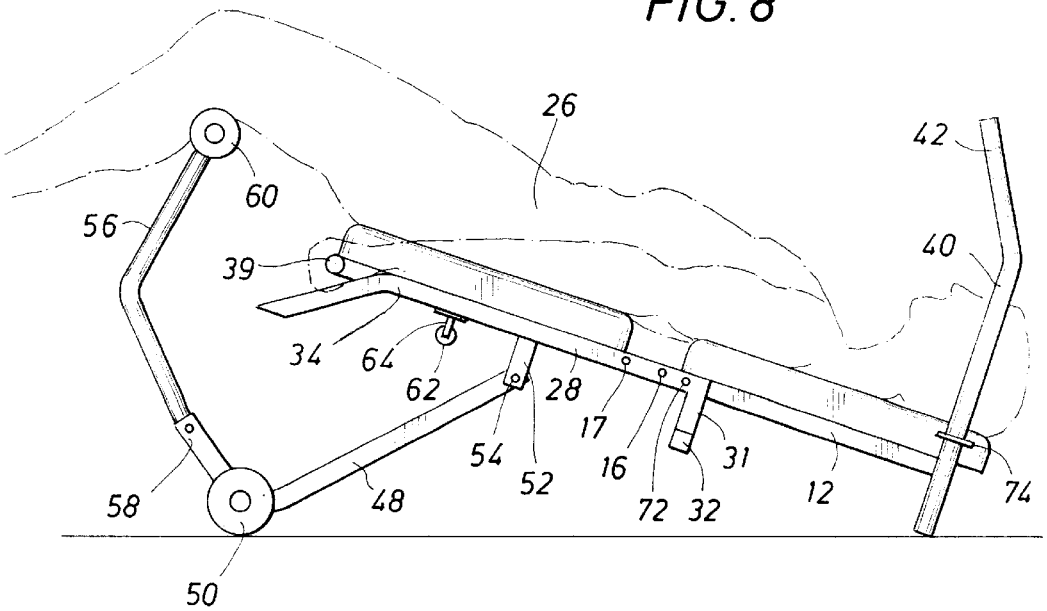
FIG. 8 is a side elevation view of the exercise apparatus of the invention depicting a user on the exercise apparatus in the end position for the glute extension exercise.

In FIGS. 7 and 8, operation of the apparatus 10 to perform another alternate exercise is shown. For this exercise, the user 26 first locks the frame member 12 to the rigid frame 18 by inserting a lock pin 72 through the frame members 28, 12 and 29. The user 26 then grasps the ends 39 of the frame member 38 which extend outward from below the support pad 24 and positions his legs over the thigh pads 60 for contact with the back of his thighs. A downward force applied by the user 26 against the thigh pads 60 pivots the lever arm 48 to the position shown in FIG. 8 thereby lifting the foot end of the apparatus 10 off the surface 20. As the lever arm 48 pivots about the pivot pin 54, the rollers 50 roll a small distance as the foot end of the apparatus 10 lifts off the surface 20. Resistance to such movement for exercising the glute muscles is provided by the body weight of the user 26.

Weights 74 may be added on the handle grips 39 of the lower back support frame 14 or arms 40 of the upper back support frame 12, or both, to increase exercise resistance.

Figure 9:
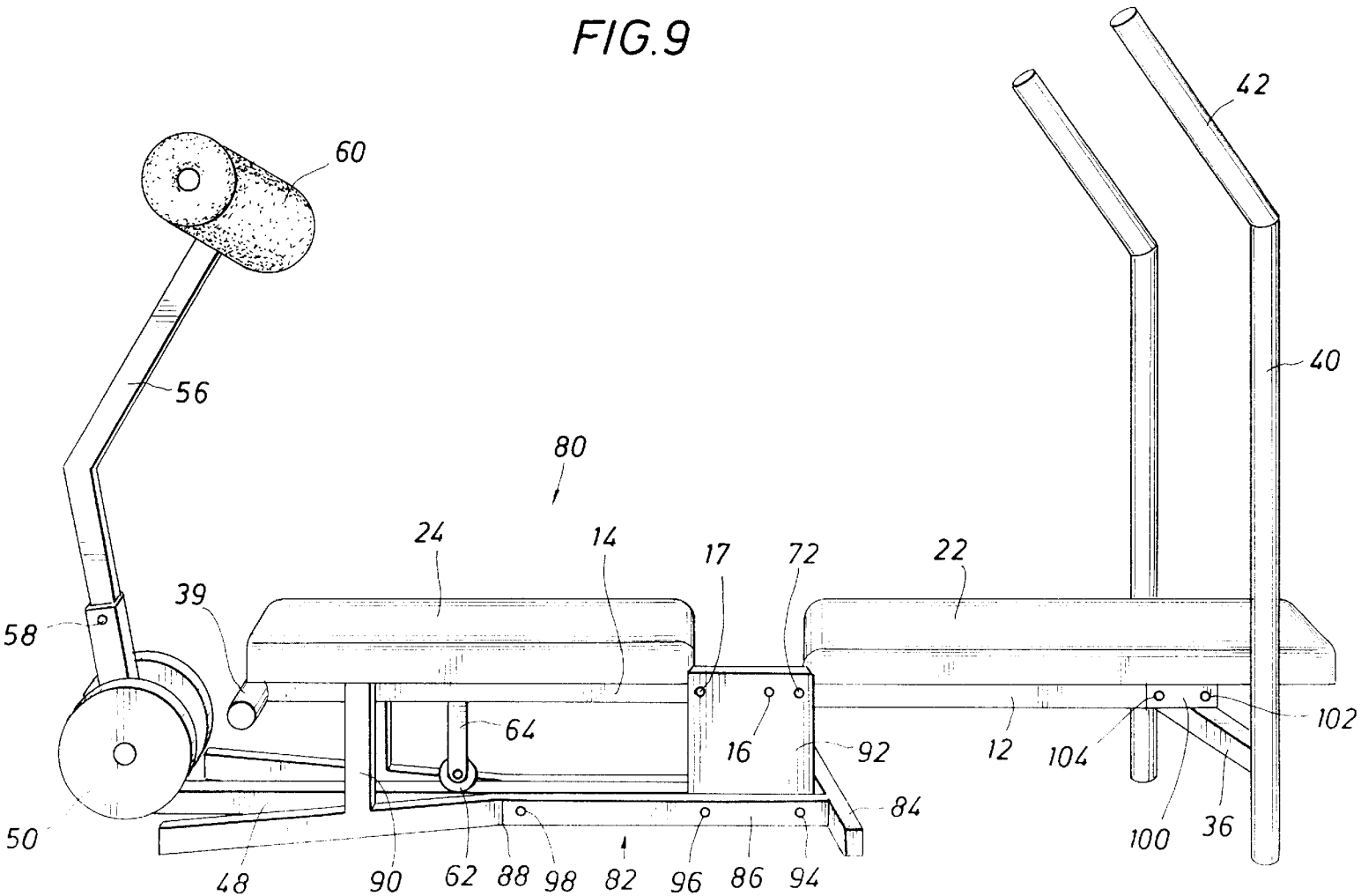
FIG. 9 is a perspective view of an alternate embodiment of the exercise apparatus of the invention.

Referring now to FIGS. 9–11, an alternate embodiment of the exercise apparatus of the invention, generally identified by the reference numeral 80, is shown. The apparatus 80 is substantially similar to the apparatus 10 described above. Therefore, the same reference numerals will be used to identify like components. In the embodiment of FIGS. 9–12, a rigid base 82 comprises a transverse member 84 and a pair of longitudinally extending members 86 extending from the transverse member 84 toward the foot end of the apparatus 80. The longitudinal members are spaced and parallel to each other to about the juncture 88. At the juncture 88, the members 86 diverge outward toward the foot end of the apparatus 80. Upstanding support posts 90 extend upward from the diverging portions of the members 86 for supporting the lower back pad 24 above the surface 20, but are not connected to the lower back pad 24.

A pair of connector plates 92 connect the base 82 to the frame members 12 and 14. The plates 92 are located between the members 86 adjacent to the transverse member 84. Pins 94 and 96 extending through the members 86 and plates 92 secure the connector plates 92 to the base 82. The lever arm 48 is pivotally connected to the base 82 by pivot pin 98.

The apparatus 80 is utilized by the user 26 to perform abdominal and glute exercises in the manner previously described. The apparatus 80 however may be folded for convenient storage. To this end, the transverse member 36 is pivotally mounted to the head end of the frame member 12. The member 36 extends below the frame member 12 and is connected thereto by a U-shaped bracket 100. Pins 102 and 104 connect the transverse member 36 to the frame member 12.

Referring now to FIGS. 10 and 11, the apparatus 80 is shown in various folded stages. In FIG. 10, removal of the lock pin 104 permits the handles 40 to be rotated downwardly so as to be substantially aligned with the upper back pad 22. The actuator arm 56 has been disengaged from the lever arm 48 so that the apparatus 80 may be stored under a bed. In FIG. 11, the apparatus 80 is shown in the fully folded configuration. The handles 40 are rotated downward as noted above and pin 94 is removed permitting the plates 92 to pivot about pin 96 bringing the back pads 22 and 24 in facing contact. The apparatus may then be rolled to a convenient storage location:

While a preferred embodiment of the invention has been shown and described, it is apparent that modifications and adaptations of the embodiment shown will occur to those skilled in the art. However, it is to be expressly understood that such modifications and adaptations are within the spirit and scope of the present invention as set forth in the following claims.

We claim:

1. An exercise apparatus, comprising:

(a) a rigid frame having pivotally connected upper and lower back support members, said back support members having a head end and a foot end;

(b) leverage means located at the head end of said upper back support member and at the foot end of said lower back support member for grasping by a user while performing exercises;

(c) first pivot means disposed below said lower back support member;

(d) second pivot means disposed proximate the head end of said lower back support;

(e) actuating means for actuation by the user by engaging the back of a user's thighs with said actuating means for lifting an end of said rigid frame against resistance provided by the user's body weight; and (f) means for selectively locking said upper and lower body support members against relative pivotal movement.

2. The apparatus of claim 1 wherein said first pivot means comprises a lever arm and an actuator arm pivotally secured to said rigid frame, said lever arm further including rollers mounted on an end thereof.

3. The apparatus of claim 1 including means for collapsing said upper body support member and said lower body support member into facing contact, said rigid frame forming a reduced storage profile in said collapsed condition.

4. An exercise apparatus for working the glute and abdominal muscles, comprising:

(a) a rigid frame having a head end and a foot end (b) means located on said rigid frame for grasping by a user while performing exercises;

(c) bidirectional actuating means pivotally secured to said rigid frame for actuation by a user by engaging the back or front of the user's thigh with said actuating means to implement bidirectional movement of said actuation means in one direction with the back of the user's thigh and in opposite direction with the front of a user's thigh for lifting an end of said rigid frame against resistance provided by the user's body weight; and (d) pivot means for pivotally raising an end of said rigid frame against the resistance provided by the user's body weight.

5. The apparatus of claim 1 wherein said rigid frame includes an upper body support frame member and a lower body support frame member pivotally connected in axial alignment.

6. The apparatus of claim 4 including means for selectively adjusting the force required for raising an end of said rigid frame against the resistance provided by the user's body weight.

7. The apparatus of claim 5 wherein said pivot means comprises a lever arm and an actuator arm pivotally secured to said lower body support frame member, said lever arm further including rollers mounted on an end thereof.

8. The apparatus of claim 6 wherein said means for selectively adjusting the force for raising the foot end of said rigid frame comprises an adjustable resistance wheel secured proximate the foot end of said rigid frame.

9. The apparatus of claim 7 wherein said foot end of said rigid frame is raised by applying a downward force against said actuator arm.

10. The apparatus of claim 5 including means for locking said upper body support frame member and said lower body support frame member against relative pivotal movement.

11. The apparatus of claim 4 including weights selectively secured on said rigid frame to increase exercise resistance.

12. An exercise apparatus comprising:

(a) a rigid frame having pivotally connected upper and lower back support member, said back support members having a head end and a foot end;

(b) handle located at the head end of said upper back support member and at the foot end of said lower back support member for grasping by a user while performing exercises;

(c) first pivot axis disposed below said lower back support member;

(d) second pivot axis disposed proximate the head end of said lower back support;

(e) a bidirectional actuator for actuation by the user by engaging the back or front of the user's thigh with said actuator in one direction with the back of the user's thigh and in the opposite direction with the front of the user's thigh for lifting said foot end of said lower back support member against resistance provided by the user's body weight, said bidirectional actuator including a lever arm pivotally secured to said rigid frame below said lower back support member; and (f) a resistance wheel secured proximate the foot end of said rigid frame below said lower back support member; said resistance wheel being in contact with said lever arm and rolling on said lever arm upon actuation of said bidirectional actuator by the front of the user's thigh to lift said foot end of said lower back support member.

* * * * *